US011346616B2

(12) United States Patent
Dasgupta

(10) Patent No.: US 11,346,616 B2
(45) Date of Patent: May 31, 2022

(54) DIMPLED HEAT EXCHANGER TUBE

(71) Applicant: DENSO International America, Inc., Southfield, MI (US)

(72) Inventor: Siddharth Dasgupta, Southfield, MI (US)

(73) Assignee: DENSO International America, Inc., Southfield, MI (US)

( * ) Notice: Subject to any disclaimer, the term of this patent is extended or adjusted under 35 U.S.C. 154(b) by 28 days.

(21) Appl. No.: 16/832,981

(22) Filed: Mar. 27, 2020

(65) Prior Publication Data

US 2021/0302108 A1 Sep. 30, 2021

(51) Int. Cl.

| | |
|---|---|
| ***F28F 1/08*** | (2006.01) |
| ***F28D 1/03*** | (2006.01) |
| ***B21C 37/15*** | (2006.01) |
| ***B21D 53/04*** | (2006.01) |
| ***F28D 1/053*** | (2006.01) |
| ***F28F 9/26*** | (2006.01) |

(52) U.S. Cl.

CPC ..... *F28F 1/08* (2013.01); *F28D 1/0391* (2013.01); *F28D 1/05383* (2013.01); *F28F 9/268* (2013.01); *B21C 37/151* (2013.01); *B21D 53/04* (2013.01); *F28F 2275/04* (2013.01)

(58) Field of Classification Search

CPC ..... F28F 1/022; F28F 1/08; F28F 2001/027; F28D 1/05383; F28D 1/0391; B21C 37/151; B21D 53/04

See application file for complete search history.

(56) References Cited

U.S. PATENT DOCUMENTS

| | | | | | |
|---|---|---|---|---|---|
| 3,596,495 | A * | 8/1971 | Huggins | F28D 1/0478 | 29/890.049 |
| 5,875,668 | A * | 3/1999 | Kobayashi | B21D 53/04 | 29/890.053 |
| 6,129,147 | A * | 10/2000 | Dumetz | F28D 1/0391 | 165/177 |
| 6,230,533 | B1 * | 5/2001 | Laveran | B21C 37/14 | 165/177 |
| 6,241,012 | B1 * | 6/2001 | Yu | F28D 1/0391 | 165/177 |
| 7,086,153 | B2 * | 8/2006 | Yamauchi | B21C 37/151 | 29/890.045 |
| 7,823,630 | B2 * | 11/2010 | Itoh | F28F 1/022 | 165/177 |
| 9,975,168 | B2 | 5/2018 | Riondet et al. | | |
| 10,113,811 | B2 | 10/2018 | Wilkins et al. | | |
| 2002/0020522 | A1 * | 2/2002 | Laveran | F28D 1/0391 | 165/177 |
| 2004/0007040 | A1 * | 1/2004 | Ibron | B21C 37/083 | 72/379.2 |
| 2009/0050306 | A1 * | 2/2009 | Helms et al. | F28F 1/022 | 165/183 |

FOREIGN PATENT DOCUMENTS

| | | | | |
|---|---|---|---|---|
| GB | 2159265 A | * | 11/1985 | F28F 1/022 |
| JP | H0284256 A | | 3/1990 | |
| JP | 2006162194 A | | 6/2006 | |
| WO | WO-02086408 A1 | | 10/2002 | |

* cited by examiner

*Primary Examiner* — Leonard R Leo

(74) *Attorney, Agent, or Firm* — Harness, Dickey & Pierce, P.L.C.

(57) ABSTRACT

A heat exchanger tube includes a curved wall, a leg, and a joint. The leg extends orthogonal to an end of the curved wall. The joint connects the curved wall and leg. A plurality of dimples is aligned along the joint.

15 Claims, 3 Drawing Sheets

DIMPLED HEAT EXCHANGER TUBE

FIELD

The present disclosure relates to heat exchanger tubes, and specifically, to a dimpled heat exchanger tube.

BACKGROUND

This section provides background information related to the present disclosure which is not necessarily prior art.

Heat exchangers, such as radiators, often include a core plate, an inlet tank, and an outlet tank. Radiator tubes extend the length of the core plate and transport coolant from the engine and across the core plate for cooling. Radiators are often manufactured by brazing. During manufacture, a single sheet may be folded into the shape of a radiator tube. Sometimes during the folding process, vertical portions of the tube become over-bent. When the tubes are brazed, the over-bent portions are not brazed the length of the vertical portion.

SUMMARY

This section provides a general summary of the disclosure, and is not a comprehensive disclosure of its full scope or all of its features.

An example embodiment of a heat exchanger tube according to the present disclosure includes a curved wall, a leg, and a joint. The leg extends orthogonal to an end of the curved wall. The joint connects the curved wall and leg. A plurality of dimples is aligned along the joint.

The example embodiment of the heat exchanger tube may include a curved wall and a leg that form a D-shaped half.

The example embodiment of the heat exchanger tube may include two D-shaped halves that are disposed symmetrically about a center longitudinal axis.

The example embodiment of the heat exchanger tube may include a divider separating the D-shaped halves.

The example embodiment of the heat exchanger tube may include a divider that is a U-shaped divider.

The example embodiment of the heat exchanger tube may include a plurality of dimples that are spaced evenly along the joint.

The example embodiment of the heat exchanger tube may include a plurality of dimples that are circular dimples.

The example embodiment of the heat exchanger tube may include each of the plurality of dimples having a radius within a range of 0.01 millimeters to 5 millimeters.

An example embodiment of a heat exchanger according to the present disclosure may include an inlet tank, an outlet tank, and a core. The inlet tank receives liquid coolant. The outlet tank dispenses liquid coolant. The core is disposed between the inlet tank and the outlet tank. The core includes a plurality of heat exchanger tubes. Each of the plurality of heat exchanger tubes includes a curved wall, a leg, a joint, and a plurality of dimples. The leg extends orthogonal to an end of the curved wall. The joint connects the curved wall and the leg. The plurality of dimples is aligned along the joint.

The example embodiment of the heat exchanger may include a curved wall and a leg that form a D-shaped half of each of the plurality of heat exchanger tubes.

The example embodiment of the heat exchanger may include two D-shaped halves that are disposed symmetrically about a center longitudinal axis of each of the plurality of heat exchanger tubes.

The example embodiment of the heat exchanger may include a divider separating the D-shaped halves and extending along the center longitudinal axis.

The example embodiment of the heat exchanger may include a divider that is a U-shaped divider.

The example embodiment of the heat exchanger may include a plurality of dimples that are spaced evenly along the joint of each of the plurality of heat exchanger tubes.

The example embodiment of the heat exchanger may include a plurality of dimples that are circular dimples.

An example embodiment of a method of forming a heat exchanger tube according to the present disclosure includes bending, with a metal bender, a plate into a pair of D-shaped arms divided by a U-shaped divider; and stamping, with a metal stamper, a plurality of dimples along a joint in each of the pair of D-shaped arms.

The example embodiment of the method may further include bending the plate such that each of the pair of D-shaped arms includes a curved wall and a vertical leg extending orthogonally from an end of the curved wall, the joint being an intersection between the curved wall and the vertical leg.

The example embodiment of the method may further include stamping the plurality of dimples spaced evenly along the joint.

The example embodiment of the method may further include stamping each of the plurality of dimples to be a circular dimple.

The example embodiment of the method may further include each of the plurality of dimples having a radius within a range of 0.01 millimeters to 5 millimeters.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
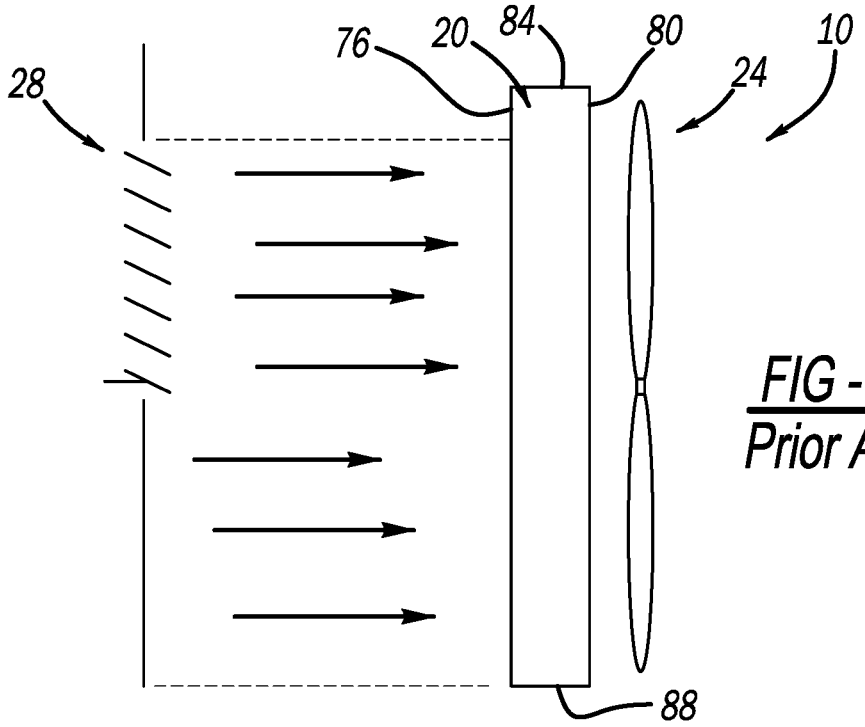
FIG - 1 Prior Art
FIG. 1 is an illustration of an example cooling system in a vehicle.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
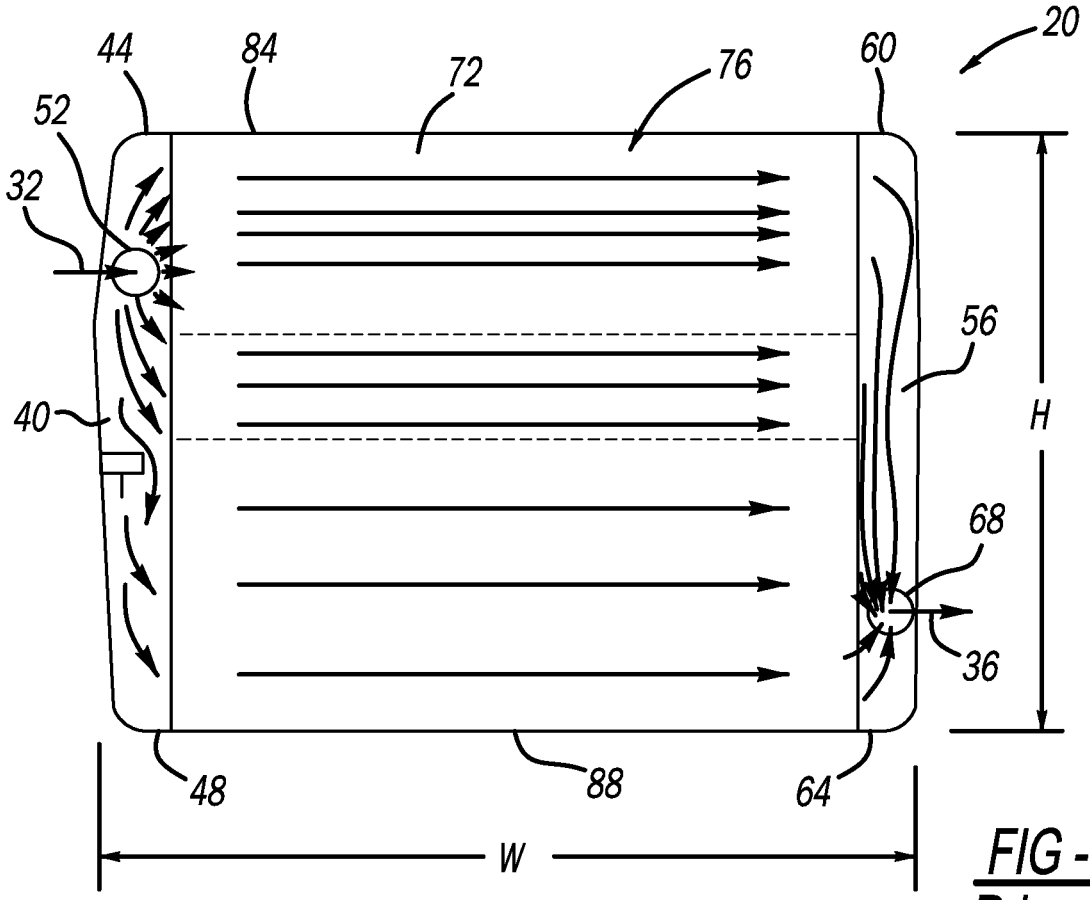
FIG - 2 Prior Art
FIG. 2 is a front view of an example heat exchanger of the cooling system in FIG. 1.

With initial reference to FIGS. 1 and 2, a cooling system is generally illustrated at reference numeral 10. The cooling system 10 is suitable for cooling any suitable device, such as a vehicle engine. The engine may be installed in a vehicle, or the cooling system 10 is suitable for cooling any suitable non-vehicular engine as well. With respect to vehicles, the engine may power a passenger vehicle or any other suitable vehicle, such as any recreational vehicle, mass transit vehicle, military vehicle, construction vehicle/equipment, watercraft, aircraft, etc.

The cooling system 10 further includes a heat exchanger 20, which can be any suitable heat exchanger, such as a radiator 20. The radiator 20 may be arranged between a fan 24 and a grill 28 and may include obstacles therebetween. The radiator 20 is connected to the engine by coolant tubes 32 and 36. Coolant tube 32 provides a conduit for engine coolant flowing from the engine to the radiator 20. Coolant tube 36 provides a conduit for coolant flowing from the radiator 20 back to the engine.

The radiator 20 includes an inlet tank 40, which has an upper end 44 and a lower end 48. The inlet tank 40 includes an inlet 52, which, in the example illustrated, is closer to the upper end 44 than the lower end 48. Coolant is introduced into the inlet tank 40 through the inlet 52. Thus the inlet 52 can be connected to the coolant tube 32, which extends from the engine to the inlet 52.

The radiator 20 further includes an outlet tank 56, which has an upper end 60 and a lower end 64. The outlet tank 56 includes an outlet 68, through which coolant can exit the outlet tank 56. In the example illustrated, the outlet 68 is closer to the lower end 64 than the upper end 60.

Between the inlet tank 40 and the outlet tank 56 is a core 72 (that may include at least one core plate) of the radiator 20. The core 72 includes a plurality of coolant conduits (such as coolant tubes or radiator tubes, for example, shown in FIG. 4) extending between the inlet tank 40 and the outlet tank 56. The coolant conduits of the core 72 transport coolant from the inlet tank 40 to the outlet tank 56.

The radiator 20 is arranged such that an upstream side 76 faces the grill 28, and a downstream side 80 faces the fan 24. The radiator 20 has a width W extending from the inlet tank 40 to the outlet tank 56, and across the core 72. A height H of the radiator 20 extends between an upper end 84 and a lower end 88 of the core 72 (as well as between the upper end 44 and the lower end 48 of the inlet tank 40, and further between the upper end 60 and the lower end 64 of the outlet tank 56).

Figure 4:
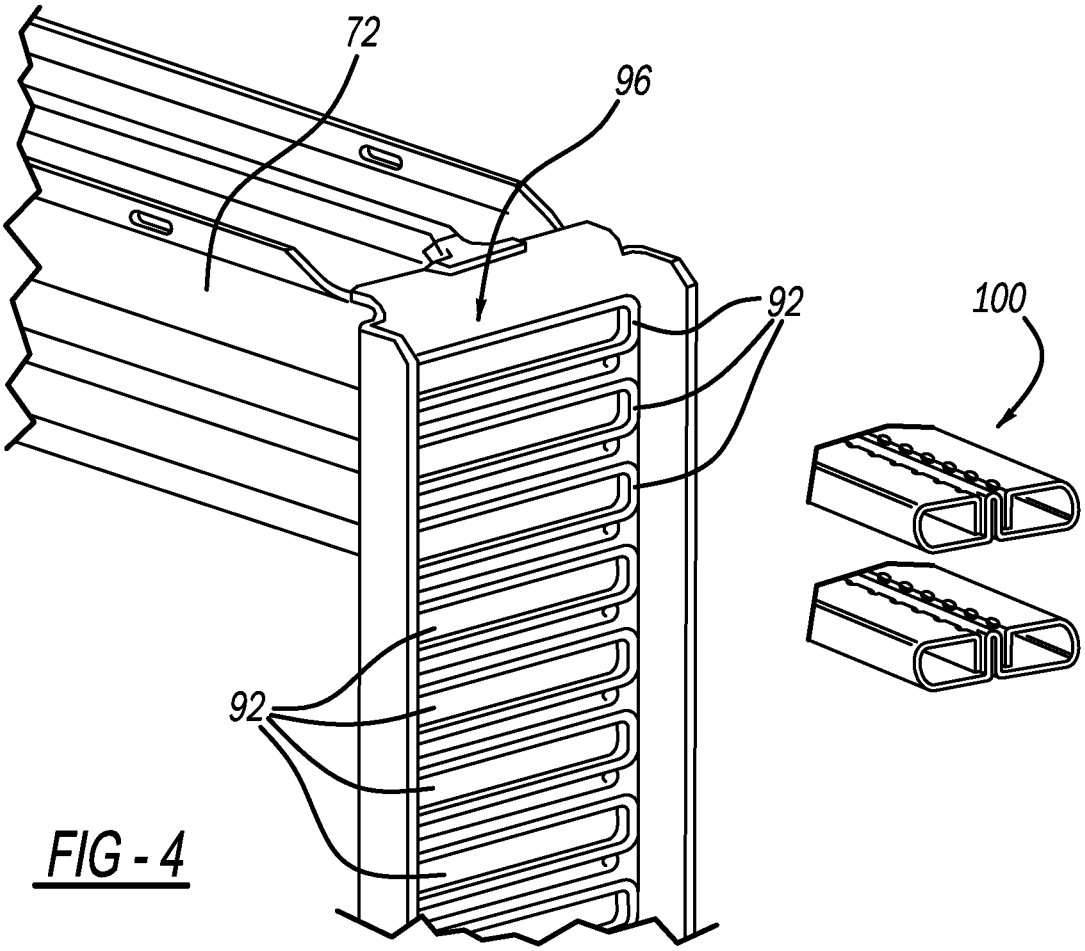
FIG. 4 is a detailed view of the heat exchanger of FIG. 2 with an example heat exchanger tube according to the present disclosure.

With additional reference to FIG. 4, a view of an example core 72 before the inlet tank 40 is crimped is shown. A plurality of coolant tubes 92 terminate at an end 96 of the core 72 that meets the inlet tank 40. The coolant tubes 92, as previously mentioned, extend the width of the core 72 between the inlet tank 40 and the outlet tank 56. During use of the radiator 20, the plurality of coolant tubes 92 transports coolant from the inlet tank 40 to the outlet tank 56 to cool, or reduce a temperature of, the coolant. As coolant flows into the plurality of coolant tubes 92 at the inlet tank 40, the coolant is at an increased temperature, for example only, at or greater than a temperature at which a thermostat opens.

Figure 5:
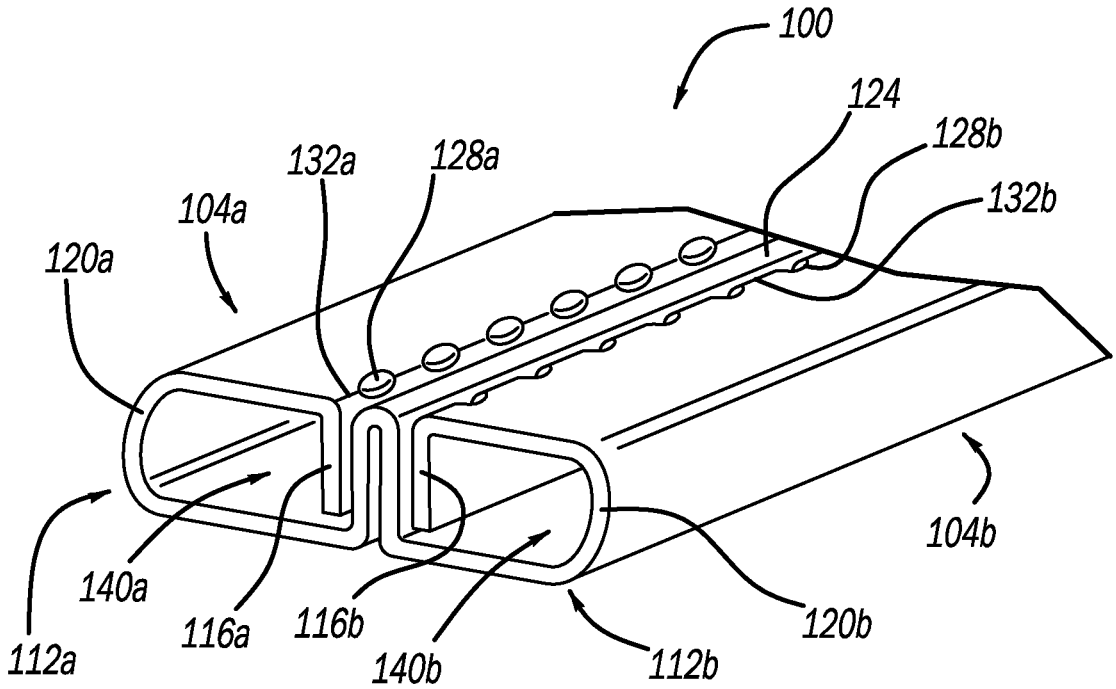
FIG. 5 is a perspective view of the example heat exchanger tube in FIG. 4.
Figure 6:
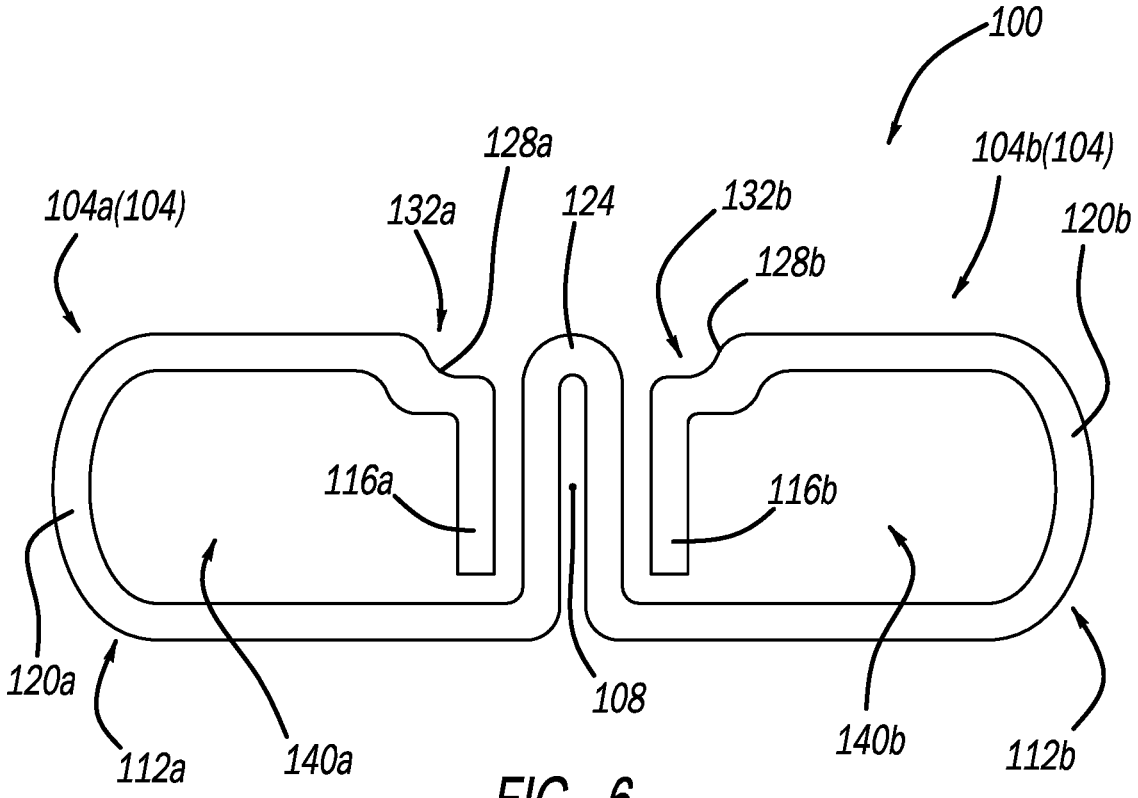
FIG. 6 is a cross-sectional view of the example heat exchanger tube of FIG. 5.

With additional reference to FIGS. 5 and 6, an example heat exchanger tube 100 of the present disclosure is illustrated. The heat exchanger tube 100 may fit within the slot of coolant tubes 92 to extend the width of the core 72 between the inlet tank 40 and the outlet tank 56.

The heat exchanger tube 100 may include a pair of halves 104 (104*a*, 104*b*) that are symmetrical about a center longitudinal axis 108 of the heat exchanger tube 100. Each half

104*a*, 104*b* of the tube 100 may include a D-shaped arm 112*a*, 112*b* having a vertical leg 116*a*, 116*b* and a curved wall 120*a*, 120*b*. In an example embodiment, the curved wall 120*a*, 120*b* may be a U-shaped wall having legs and a curved portion. The vertical leg 116*a*, 116*b* may extend orthogonally from an end of the curved wall 120*a*, 120*b* where the vertical leg 116*a*, 116*b* is attached to the curved wall 120*a*, 120*b*. The halves 104 are separated by a U-shaped divider 124 that connects to each of the curved walls 120*a*, 120*b* and extends vertically alongside the vertical legs 116*a*, 116*b*.

When the heat exchanger tube 100 is formed, a flat sheet of material (for example, metal such as aluminum, steel, etc.) is bent into the desired shape having the D-shaped arms 112*a*, 112*b* and U-shaped divider 124. As such, the heat exchanger tube 100 is a single, monolithic piece.

The heat exchanger tube 100 may additionally include dimples, dents, or stamped ridges 128*a*, 128*b* along a radius section of a joint 132*a*, 132*b* between the curved walls 120*a*, 120*b* and the vertical legs 116*a*, 116*b*, respectively, to increase the stiffness of the joint 132*a*, 132*b* and maintain the vertical legs 116*a*, 116*b* in a vertical configuration (as opposed to slanted inward or outward with respect to vertical). The vertical configuration of the vertical legs 116*a*, 116*b* improves brazing with a vertical portion of the U-shaped divider 124 (as explained below). In an example embodiment, the dimples 128*a*, 128*b* may be circular, rectangular, or slot-shaped to increase the stiffness of the joint 132*a*, 132*b*.

Each of the dimples 128*a*, 128*b* may be sized to add a predetermined stiffness to the joint 132*a*, 132*b*. For example, the dimples 128*a*, 128*b* may have a radius within a range of about 0.01 millimeters to 5 millimeters to increase the stiffness of the joint by approximately 1.2 times (for a 0.01 mm radius) to 2500 times (for a 5 mm radius) and keep the legs straight in a vertical configuration.

In an example embodiment, the dimples 128*a*, 128*b* may be evenly spaced along the joints 132*a*, 132*b*. For example, the dimples 128*a*, 128*b* may be spaced within a range of 1-20 dimples per 1 inch along the joints 132*a*, 132*b*.

In an example embodiment, the dimples 128*a*, 128*b* may be formed by stamping or rolling after the tube 100 is bent or during the bending process. For example, during manufacture, the flat sheet of material may be bent into the desired shape having the D-shaped arms 112*a*, 112*b* and U-shaped divider 124. The dimples 128*a*, 128*b* may then be stamped in the radius section of the joints 132*a*, 132*b*.

Once the desired shape of the tube 100 is formed, the vertical legs 116*a*, 116*b* are brazed to the U-shaped divider 124 to create two tubular sections 140*a*, 140*b* on opposite sides of the U-shaped divider 124. In use, the liquid coolant flowing through the radiator 20 will flow through the tubular sections 140*a*, 140*b* in the tube 100.

Figure 3:
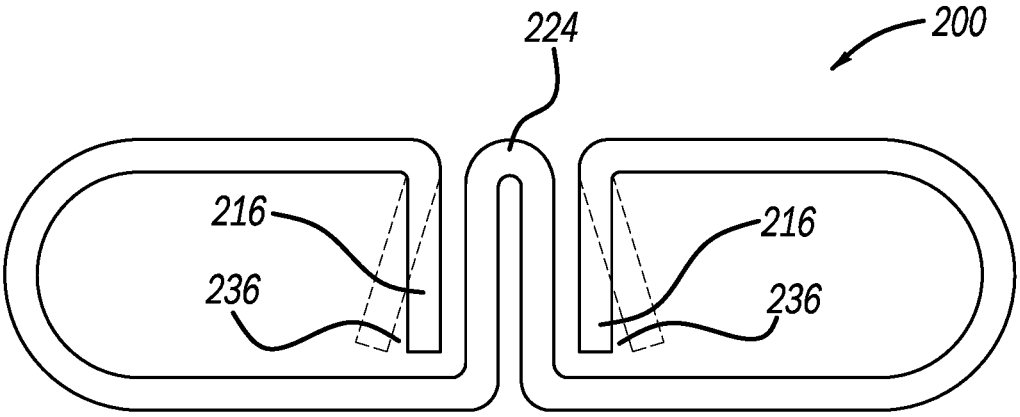
FIG - 3 Prior Art
FIG. 3 is a cross-sectional view of an example prior-art heat exchanger tube.

Previously, as illustrated in FIG. 3, heat exchanger tubes were bent as previously described from a flat sheet to the design of the heat exchanger tube 200 as illustrated in FIG. 3. However, during bending, the vertical leg 216, may be over-bent, such that it is not vertical. An example of the over-bent vertical leg 216 is illustrated in phantom in FIG. 3. The over-bent vertical leg 216 creates a gap 236 between the leg 216 and a U-shaped divider 224. The farther the leg 216 bends away from the divider 224, the larger the gap 236 therebetween. The larger the gap 236 between the leg 216 and the divider 224, the worse the brazing is between the leg 216 and the divider 224. Bad brazing between the leg 216 and the divider 224 causes leaking in the tube 200.

Referring again to FIGS. 5 and 6, the dimples 128*a*, 128*b* along the radius section of the joint 132*a*, 132*b* increase the stiffness of the joints 132*a*, 132*b* such that the vertical legs 116*a*, 116*b* remain vertical and don't over-bend or bend inwards. Thus, the presence of the dimples 128*a*, 128*b* along the radius section of the joint 132*a*, 132*b* improves the brazing between the U-shaped divider 124 and the vertical legs 116*a*, 116*b*. Improved brazing strengthens the heat exchanger tube 100 such that it does not fail during use.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A heat exchanger tube comprising:

a single sheet folded on itself to form a first channel and a second channel extending parallel and separated by a U-shaped divider, the first channel being defined by a first curved wall of the sheet and a first leg of the sheet connected by a first joint, and the second channel being defined by a second curved wall of the sheet and a second leg of the sheet connected by a second joint, wherein the first curved wall and the second curved wall extend around a longitudinal axis of the heat exchanger tube, the first leg extends orthogonal to an end of the first curved wall and parallel with the U-shaped divider, the second leg extends orthogonal to an end of the second curved wall and parallel with the U-shaped divider, the first joint connects the first curved wall and first leg and extends along the longitudinal axis, the second joint connects the second curved wall and second leg and extends along the longitudinal axis, each of the first joint and the second joint includes an internal bend and a correlating external bend defining an intersection of the curved wall and leg, a plurality of dimples are aligned along and located only on the bend in each of the first joint and the second joint, with individual dimples of the plurality of dimples being aligned along each of the first joint and the second joint, and the U-shaped divider is an undimpled curved divider that separates the individual dimples on the first joint with the individual dimples on the second joint.

2. The heat exchanger tube of claim 1, wherein the curved wall and leg form a D-shaped half.

3. The heat exchanger tube of claim 2, wherein two D-shaped halves are disposed symmetrically about a center longitudinal axis.

4. The heat exchanger tube of claim 1, wherein the plurality of dimples are spaced evenly along the joints.

5. The heat exchanger tube of claim 1, wherein the plurality of dimples are circular dimples.

6. The heat exchanger tube of claim 5, wherein each of the plurality of dimples has a radius within a range of 0.01 millimeters to 5 millimeters.

7. A heat exchanger comprising:

an inlet tank receiving liquid coolant;

an outlet tank dispensing liquid coolant; and a core disposed between the inlet tank and the outlet tank, the core including a plurality of heat exchanger tubes, each of the plurality of heat exchanger tubes including a single sheet folded on itself to form a first channel and a second channel extending parallel and separated by a U-shaped divider, the first channel being defined by a first curved wall of the sheet and a first leg of the sheet connected by a first joint, the second channel being defined by a second curved wall of the sheet and a second leg of the sheet connected by a second joint, wherein the first curved wall and the second curved wall extend around a longitudinal axis of the heat exchanger tube, the first leg extends orthogonal to an end of the first curved wall and parallel with the U-shaped divider, the second leg extends orthogonal to an end of the second curved wall and parallel with the U-shaped divider, the first joint connects the first curved wall and first leg and extends along the longitudinal axis, the second joint connects the second curved wall and second leg and extends along the longitudinal axis, each of the first joint and the second joint includes an internal bend and a correlating external bend defining an intersection of the respective first and second curved wall and first and second leg, a plurality of dimples are aligned along and located only on the bend in each of the first joint and the second joint, with individual dimples of the plurality of dimples being aligned along each of the first joint and the second joint, and the U-shaped divider is an undimpled curved divider that separates the individual dimples on the first joint with the individual dimples on the second joint.

8. The heat exchanger of claim 7, wherein the curved wall and leg form a D-shaped half of each of the plurality of heat exchanger tubes.

9. The heat exchanger of claim 8, wherein two D-shaped halves are disposed symmetrically about a center longitudinal axis of each of the plurality of heat exchanger tubes.

10. The heat exchanger of claim 7, wherein the plurality of dimples are spaced evenly along the joints of each of the plurality of heat exchanger tubes.

11. The heat exchanger of claim 7, wherein the plurality of dimples are circular dimples.

12. A method of forming a heat exchanger tube comprising:

bending, with a metal bender, a continuous sheet into a pair of D-shaped arms divided by a U-shaped divider, each of the D-shaped arms including a curved wall and a leg extending orthogonal to an end of the curved wall and parallel with the U-shaped divider, the curved wall and leg defining a D-shaped channel, the curved wall extending around a longitudinal axis of the channel, the leg being connected to the end of the curved wall at a joint, and the U-shaped divider separating the leg from a first of the pair of D-shaped arms from the leg from a second of the pair of D-shaped arms, the bending including forming the joint as a bend defining an intersection of the curved wall and leg, the joint extending along the longitudinal axis and including an internal bend and a correlating external bend; and stamping, with a metal stamper, a plurality of dimples along and located only on the bend in the joint in each of the pair of D-shaped arms, individual dimples of the plurality of dimples being aligned along the joint in each of the pair of D-shaped arms, wherein the U-shaped divider is an undimpled curved divider that separates the individual dimples aligned along the joint in the first of the pair of D-shaped arms with the individual dimples aligned along the joint in the second of the pair of D-shaped arms.

13. The method of claim 12, wherein the stamping the plurality of dimples along the joint includes stamping the plurality of dimples spaced evenly along the joints.

14. The method of claim 12, wherein the stamping the plurality of dimples along the joint includes stamping each of the plurality of dimples to be a circular dimple.

15. The method of claim 14, wherein each of the plurality of dimples has a radius within a range of 0.01 millimeters to 5 millimeters.

* * * * *